US012799650B2

(12) United States Patent
Haramo et al.

(10) Patent No.: US 12,799,650 B2
(45) Date of Patent: Nov. 17, 2026

(54) SEWING MACHINE

(71) Applicant: JANOME Corporation, Tokyo (JP)

(72) Inventors: Honoka Haramo, Hachioji (JP); Takeshi Oie, Hachioji (JP)

(73) Assignee: JANOME Corporation, Tokyo (JP)

( * ) Notice: Subject to any disclaimer, the term of this patent is extended or adjusted under 35 U.S.C. 154(b) by 0 days.

(21) Appl. No.: 19/330,765

(22) Filed: Sep. 16, 2025

(65) Prior Publication Data

US 2026/0078538 A1 Mar. 19, 2026

(30) Foreign Application Priority Data

Sep. 19, 2024 (JP) ..... 2024-162029

(51) Int. Cl.
*D05B 27/04* (2006.01)
*D05B 19/16* (2006.01)

(52) U.S. Cl.
CPC ..... *D05B 27/04* (2013.01); *D05B 19/16* (2013.01)

(58) Field of Classification Search
CPC ..... D05B 19/16; D05B 27/00; D05B 27/02; D05B 27/04; D05B 27/06
See application file for complete search history.

(56) References Cited

U.S. PATENT DOCUMENTS 6,158,365 A 12/2000 Hidechika et al.
2006/0219140 A1* 10/2006 Fukao ..... D05B 73/10 112/470.14
2007/0119354 A1* 5/2007 Ukai ..... D05B 21/00 112/78

FOREIGN PATENT DOCUMENTS

JP S5933340 Y2 9/1984
JP 2000-237478 A 9/2000
JP 3963399 B2 8/2007

* cited by examiner

*Primary Examiner* — Nathan E Durham
(74) *Attorney, Agent, or Firm* — Studebaker Brackett PLLC

(57) ABSTRACT

Provided is a sewing machine comprising: a feed dog drive mechanism to drive a feed dog; a switching mechanism connected to the feed dog drive mechanism and configured to be slid in a right-left direction to switch between an operating state and a non-operating state of the feed dog; and a carriage drive mechanism to drive a carriage which holds an embroidery frame, wherein the carriage drive mechanism is configured to be switchable between an unfolded state and a folded state thereof, and the carriage and the switching mechanism are configured to form, in the folded state, a state in which the carriage can press the switching mechanism to slide the switching mechanism, whereby when the carriage is moved in the eight-left direction in the folded state, the switching mechanism is slid, and thus the operating state and the non-operating state of the feed dog are switched therebetween.

10 Claims, 9 Drawing Sheets

SEWING MACHINE

BACKGROUND OF THE INVENTION

Field of the Invention

The present invention relates to a sewing machine for forming stitches on cloth by moving a needle up and down.

Description of Related Art

Heretofore, there has been known a sewing machine comprising: a feed dog for feeding cloth in a front-rear direction; a feed dog drive mechanism for reciprocating the feed dog in the front-rear direction and in an up-down direction; and a switching mechanism capable of driving the feed dog drive mechanism to switch between an operating state in which the feed dog is allowed to function to feed the cloth and a non-operating state in which the feed dog is prevented from functioning to feed the cloth. For example, Patent Document 2 (Japanese Utility Model Publication No. JP S59-033340 Y2) proposes a sewing machine configured to reciprocate a feed dog in an up-down direction by an up-down feed cam, wherein the sewing machine comprises a switching mechanism (feed dog drop mechanism) capable of disengaging the feed dog from the up-down feed cam (shifting the feed dog to the non-operating state).

There has also been known a technique of allowing the switching between the operating and non-operating states of the feed dog to be performed automatically by a solenoid or motor, as well as manual control by a lever. For example, Patent Document 2 (JP 3963399 B2) proposes a technique used in a sewing machine comprising a carriage drive mechanism (X-Y drive mechanism) configured to move a carriage which holds an embroidery frame, in a right-left direction (X-direction) and in a front-rear direction (Y-direction) to embroider cloth held by the embroidery frame, wherein the technique is capable of automatically switching between the operating and non-operating states of the feed dog, using the movement of the carriage drive mechanism.

In addition to the above, a technique related to the present invention is further proposed in Patent Document 3 (JP 2000-237478 A). Specifically, Patent Document 3 proposes a technique, wherein the carriage drive mechanism as mentioned above is composed of two linear drive mechanisms (X-arm and Y-arm) capable of driving a carriage in a right-left direction (X-direction) and a front-rear direction (Y-direction), respectively, wherein this carriage drive mechanism is configured to be switched between an unfolded state in which the two linear drive mechanisms have a positional relationship where respective linear drive directions thereof are orthogonal to each other, and a folded state in which the two linear drive mechanisms have a positional relationship where the respective linear drive directions thereof are parallel to each other. According to this technique, when embroidering is not performed in a sewing machine, the carriage drive mechanism can be placed in the folded state to improve the easiness of storage of the sewing machine, etc.

BRIEF SUMMARY OF THE INVENTION

Technical Problem

In the technique described in the above Patent Document 2, the operating and non-operating states of the feed dog are automatically switched using the movements of a carriage in the right-left direction (X-direction) and the front-rear direction (Y-direction). When applying the technique described in Patent Document 2 to the technique described in Patent Document 3 in which the carriage drive mechanism can be switched between the unfolded state and the folded state, there is the following technical problem.

This technical problem arises, particularly, when the technique described in Patent Document 2 is applied to the carriage drive mechanism in the folded state. Specifically, in the folded state, the two linear drive mechanisms (X-arm and Y-arm) have the positional relationship where the respective linear drive directions thereof are parallel to each other, i.e., the carriage cannot be moved in both the right-left direction (X-direction) and the front-rear direction (Y-direction). This makes it impossible to apply the technique described in Patent Document 2, which uses both the movements of the carriage in the right-left direction (X-direction) and the front-rear direction (Y-direction).

The present invention has been made to solve the above-mentioned technical problem, and an object thereof is to, in a sewing machine comprising a carriage drive mechanism capable of moving a carriage which holds an embroidery frame and switching between an unfolded state and a folded state of two linear drive mechanisms constituting the carriage drive mechanism, make it possible to adequately switch between operating and non-operating states of a feed dog, in the folded state.

Solution to Problem

In order to achieve the above object, the present invention provides a sewing machine for forming stitches on cloth by moving a needle up and down. The sewing machine comprises: a feed dog which feeds cloth in a front-rear direction; a feed dog drive mechanism which drives the feed dog to cause the feed dog to reciprocate in a front-rear direction and in an up-down direction; a switching mechanism connected to the feed dog drive mechanism, and configured to slide in a first direction in order to switch between an operating state in which the feed dog is allowed to function to feed the cloth and a non-operating state in which the feed dog is prevented from functioning to feed the cloth; a carriage which holds an embroidery frame for embroidering the cloth; and a carriage drive mechanism comprising a first linear drive mechanism and a second linear drive mechanism each capable of driving the carriage linearly, wherein a linear drive direction of the first linear drive mechanism is the first direction and a linear drive direction of the second linear drive mechanism is a second direction orthogonal to the first direction, such that the carriage drive mechanism is configured to move the carriage in the first and second directions, wherein the carriage drive mechanism is configured to switch between an unfolded state in which the first and second linear drive mechanisms have a positional relationship where the respective linear drive directions thereof are orthogonal to each other, and a folded state in which the first and second linear drive mechanisms have a positional relationship where the respective linear drive directions thereof are parallel to each other, and wherein the switching mechanism can slide by being pressed by the carriage when the carriage drive mechanism is in the folded state, such that the switching mechanism slides when the carriage drive mechanism in the folded state moves the carriage in the first direction, so as to switch between the operating state and the non-operating state of the feed dog.

The present invention having the above feature makes it possible to, in the folded state of the cartridge drive mechanism, adequately switch between the operating and non-operating states of the feed dog through the switching mechanism, using the movement of the carriage by the carriage drive mechanism.

Preferably, in the above sewing machine, the carriage and the switching mechanism are configured to at least partially engage with each other, when the carriage drive mechanism is in the folded state.

According to the present invention having this feature, in the folded state of the cartridge drive mechanism, it becomes possible to realize sliding movement of the switching mechanism by the carriage, with a simple configuration.

Preferably, in the above sewing machine, the switching mechanism comprises a first to-be-pressed part provided on a side of one direction of the first direction, and a second to-be-pressed part provided on a side of the other direction of the first direction; and the carriage comprises a first pressing part provided to engage with the switching mechanism between the first to-be-pressed part and the second to-be-pressed part of the switching mechanism, when the carriage drive mechanism is in the folded state, and the sewing machine is configured such that in a situation where the carriage drive mechanism is in the folded state, (i) when the carriage is moved in said one direction, the first pressing part of the carriage presses the first to-be-pressed part of the switching mechanism and the switching mechanism slides in said one direction, whereby the feed dog is placed in the operating state, and (ii) when the carriage is moved in said other direction, the first pressing part of the carriage presses the second to-be-pressed part of the switching mechanism and the switching mechanism slides in said other direction, whereby the feed dog is placed in the non-operating state.

According to the present invention having this feature, in the folded state of the cartridge drive mechanism, it becomes possible to reliably switch between the operating and non-operating states of the feed dog by the carriage and the switching mechanism.

Preferably, in the above sewing machine, the carriage further comprises a second pressing part provided to be contactable with a face of the second to-be-pressed part of the switching mechanism on the side of said one direction of the first direction or on the side of said other direction of the first direction, when the carriage drive mechanism is in the unfolded state, and the sewing machine is configured such that in a situation where the carriage drive mechanism is in the unfolded state, (i) when the carriage is moved in said one direction with the second pressing part of the carriage being in contact with the face of the second to-be-pressed part of the switching mechanism on the side of said other direction, the second pressing part of the carriage presses the second to-be-pressed part of the switching mechanism and the switching mechanism slides in said one direction, whereby the feed dog is placed in the operating state, and (ii) when the carriage is moved in said other direction with the second pressing part of the carriage being in contact with the face of the second to-be-pressed part of the switching mechanism on the side of said one direction, the second pressing part of the carriage presses the second to-be-pressed part of the switching mechanism and the switching mechanism slides in said other direction, whereby the feed dog is placed in the non-operating state.

According to the present invention having this feature, in the unfolded state of the cartridge drive mechanism, it becomes possible to reliably switch between the operating and non-operating states of the feed dog by the carriage and the switching mechanism.

Preferably, in the above sewing machine, in conjunction with an operation by which the carriage drive mechanism is switched from the unfolded state to the folded state, the first pressing part of the carriage presses the first to-be-pressed part of the switching mechanism and the switching mechanism slides in said one direction, whereby the feed dog is placed in the operating state when the carriage drive mechanism has been switched to the folded state.

According to the present invention having this feature, it becomes possible to switch the feed dog from the non-operating state to the operating state, in conjunction with the operation of shifting the carriage drive mechanism from the unfolded state to the folded state.

Preferably, in the above sewing machine, the first pressing part of the carriage and the first to-be-pressed part of the switching mechanism are formed, respectively, with inclined faces which are opposed to each other in the folded state, and come into contact with each other during the pressing of the first to-be-pressed part by the first pressing part.

According to the present invention having this feature, the first pressing part of the carriage and the first to-be-pressed part of the switching mechanism can be brought into contact with each other through their inclined faces, so that it becomes possible to mitigate a force applied during the pressing of the first to-be-pressed part by the first pressing part.

Preferably, in the above sewing machine, at least a portion of the first pressing part is composed of an elastically-deformable resilient member.

According to the present invention having this feature, the second to-be-pressed part of the switching mechanism can be pressed by the resilient member constituting the first pressing part of the carriage. In this case, it becomes possible to mitigate a force applied during the pressing of the second to-be-pressed part by the second to-be-pressed part.

Preferably, the sewing machine of the present invention further comprises: a first sensor capable of detecting the unfolded state and the folded state of the carriage drive mechanism; and a control unit configured to switch between movements of the carriage for sliding the switching mechanism, based on the state of the carriage drive mechanism defected by the first sensor.

According to the present invention having this feature, it becomes possible to adequately switch between the operating and non-operating states of the feed dog, in consideration of the state (unfolded state/folded state) of the carriage drive mechanism.

Preferably, the sewing machine of the present invention further comprises a control unit configured to control a movement of the carriage drive mechanism to switch between the operating state and the non-operating state of the feed dog, based on a plurality of operational modes of the sewing machine.

According to the present invention having this feature, it becomes possible to adequately switch between the operating and non-operating states of the feed dog in consideration of the operational modes of the sewing machine.

Preferably, the sewing machine of the present invention further comprises: a second sensor capable of detecting the operating state and the non-operating state of the feed dog; and a control unit configured to determine whether or not the state of the feed dog detected by the second sensor is in a set desired state, and to perform a predetermined control operation according to a result of the determination.

According to the present invention having this feature, when the state (operating state/non-operating state) of the feed dog is not in the desired state, it becomes possible to adequately perform control for correcting this state of the feed dog.

According to the above-mentioned present invention, in the sewing machine comprising the carriage drive mechanism capable of moving the carriage which holds the embroidery frame and switching between the unfolded state and the folded state of the two linear drive mechanisms, it becomes possible to adequately switch between the operating and non-operating states of the feed dog, in the folded state.

DETAILED DESCRIPTION OF THE INVENTION

With reference to the drawings, an embodiment of the present invention will be described. It should be noted that in all figures for illustrating the embodiment, the same reference sign is assigned to the same members or elements in principle, and repetitive descriptions thereof will be omitted.

Apparatus Configuration

Figure 1:
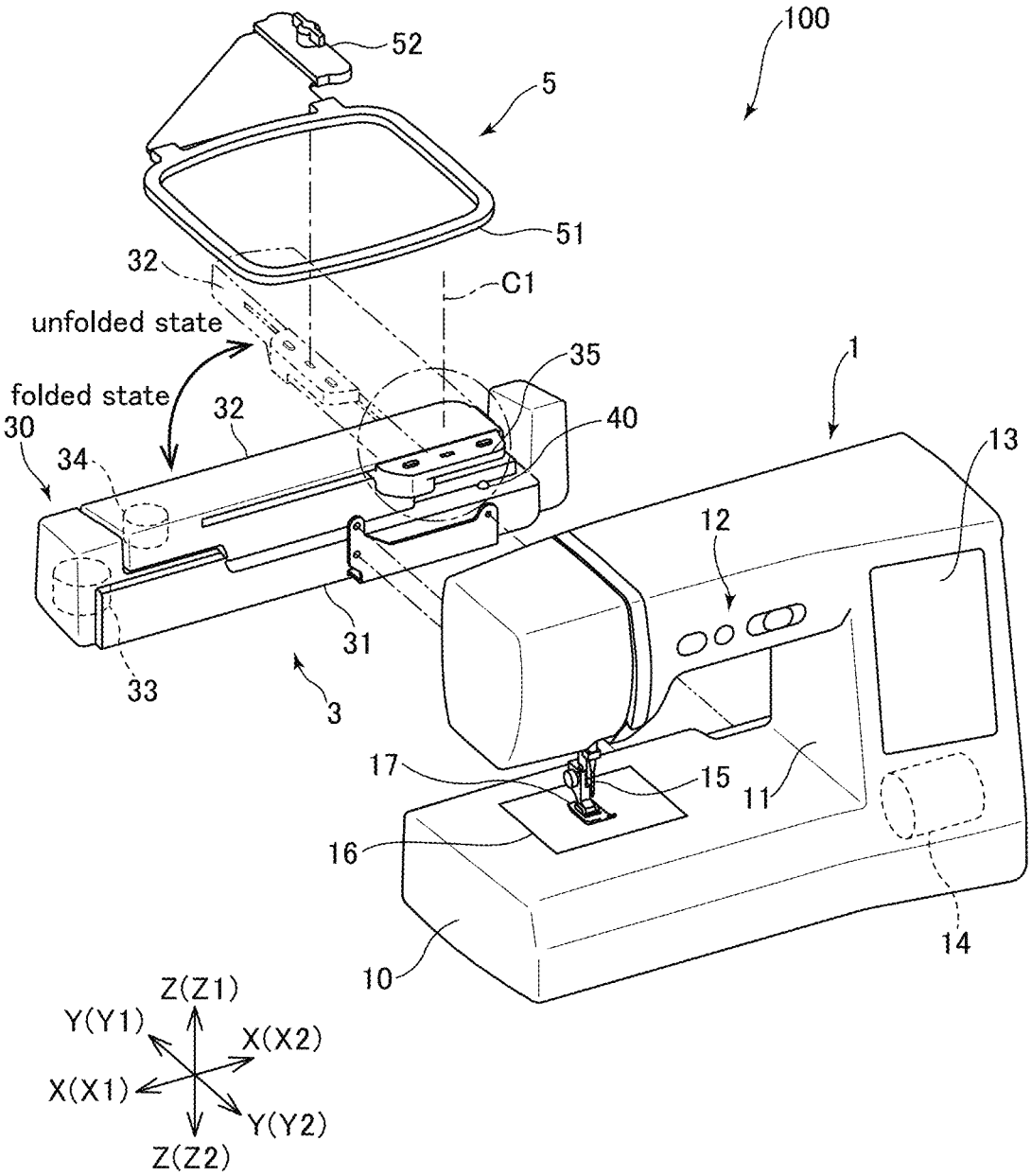
FIG. 1 is a perspective view showing the external appearance of a sewing machine according to an embodiment of the present invention.

First of all, with reference to FIG. 1, the overall configuration of a sewing machine according to this embodiment will be described. FIG. 1 is a perspective view showing the external appearance of the sewing machine according to this embodiment.

Here, in FIG. 1 (the following also applies to other figures), an up-down direction, a right-left direction (lateral direction), and a front-rear direction (depth direction) in the sewing machine 100 are denoted by "Z", "X", and "Y", respectively. More specifically, in the up-down direction Z, an up direction and a down direction are denoted by "Z1" and "Z2", respectively. In the right-left direction X, a leftward direction and a rightward direction are denoted by "X1" and "X2", respectively. In the front-rear direction Y, a forward direction and a rearward direction are denoted by "Y1" and "Y2", respectively. The right-left directions X and the front-rear direction Y correspond, respectively, to "first direction" and "second direction" set forth in the appended claims, and the leftward direction X1 and the rightward direction X2 correspond, respectively, to "one direction" and "the other direction" set forth in the appended claims (in this case, the left side and the right side correspond, respectively, to "side of one direction" and "side of the other direction" set forth in the appended claims).

As shown in FIG. 1, a sewing machine 100 mainly comprises a machine main unit 1 configured to form stitches on cloth, and an embroidery unit 3 detachably attached to the machine main unit 1 and configured to hold an embroidery frame 5. First, the machine main unit 1 mainly comprises: a base 10; a machine arm 11 extending from the base 10; an operation unit 12 configured to be operated by a user; a display unit 13 on which various information is to be displayed; a drive motor 14 serving as a power source for allowing the machine main unit 1 to create various movements; a needle 15 for forming stitches on cloth (not shown); a needle plate 16 covering the periphery of an area into which the needle descends; and a presser 17 for pinching and holding the cloth in cooperation with the needle plate 16.

The machine main unit 1 sews cloth by intertwining an upper thread (not shown) and a lower thread (not shown) to form stitches. In this case, the upper thread is provided from a thread spool (not shown) and is inserted into the needle 15, and the lower thread is stored in a bobbin (not shown), wherein the bobbin is housed in a bobbin case or shuttle (not shown), and the shuttle is stored inside the machine main unit 1. The cloth is held and secured between the needle plate 16 and the presser 17. Further, an up-down movement of the needle 15, a rotational movement of the shuttle, and forward-rearward and up-down movements of a feed dig (not shown) for feeding the cloth are created inside the machine main unit 1 by a torque of the drive motor 14.

Specifically, in the machine main unit 1, the needle 15 with the upper thread inserted thereinto is moved to penetrate the cloth and come closer to the bobbin, and then the lower thread and upper thread are intertwined by the action of the shuttle, whereafter the needle 15 is moved to ascend and get out of the cloth, whereby a stitch is formed on the cloth. Then, the feed dog feeds the cloth by a predetermined amount in the forward direction Y1, and the next stitch is formed in the same process as that described above. In this way, a linear continuous sewing pattern in which stitches are formed at predetermined intervals is applied to the cloth. It should be noted that forming stitches in this manner will hereinafter be appropriately referred to as "normal stitching".

Next, the embroidery unit 3 comprises: a carriage 35 which holds the embroidery frame 5; and a carriage drive mechanism 30 comprising an X-arm 31 capable of driving the carriage 35 in the right-left direction X, and a Y-arm 32 capable of driving the carriage 35 in the front-rear direction Y. On the other hand, the embroidery frame 5 comprises a ring-shaped frame part 51 for holding cloth, and a fixation part 52 connected to the frame part 51 and for fixation to the carriage 35. In the embroidery unit 3, the X-arm 31 and the Y-arm 32 correspond, respectively, to "first linear drive mechanism" and "second linear drive mechanism" set forth in the appended claims.

The carriage drive mechanism 30 is configured such that the Y arm 32 is rotatable (pivotable) 90 degrees with respect to the X-arm 31 about a rotation center C1. This allows the carriage drive mechanism 30 to take a folded state (which is indicated by solid lines in FIG. 1) in which the X-arm 31 and the Y-arm 32 have a positional relationship where respective linear drive directions thereof are parallel to each other, specifically, a positional relationship where the Y-arm 32 is superimposed on the X-arm 31, and a unfolded state (which is indicated by broken lines in FIG. 1) in which the X-arm 31 and the Y-arm 32 have a positional relationship where the respective orthogonal directions thereof are orthogonal to each other, specifically, a positional relationship where the Y arm 32 is rotated 90 degrees with respect to the X arm 31.

An embroidery unit rotational position sensor 40 is provided on the upper surface of the X-arm 31, and disposed to be pushed down by a rear end of the Y-arm 32 which has been rotated 90 degrees with respect to the X arm 31. This embroidery unit rotational position sensor 40 is capable of detecting the unfolded and folded states of the carriage drive mechanism 30. Specifically, the embroidery unit rotational position sensor 40 detects that the carriage drive mechanism 30 is in the unfolded state when said sensor is pushed down, and detects that the carriage drive mechanism 30 is in the folded state when said sensor is not pushed down.

Further, the X-arm 31 is provided with an embroidery X-motor 33 to move the Y-arm 32 in the right-left direction X. Basically, the X-arm 31 is operable, in the unfolded state of the carriage drive mechanism 30, to move the Y-arm 32 in the right-left direction X, and is also operable, in the folded state of the carriage drive mechanism 30, to slightly move the Y-arm 32 in the right-left direction X. The Y-arm 32 is provided with an embroidery Y-motor 34 to move the carriage 35 in the front-rear direction Y. Basically, the Y-arm 32 is operable, in the unfolded state of the carriage drive mechanism 30, to move the carriage 35 in the front-rear direction Y, and is also operable, in the folded state of the carriage drive mechanism 30, to move the carriage 35 in the right-left direction.

According to the above-mentioned X-arm 31 and Y-arm 32 of the carriage drive mechanism 30, the carriage 35 is moved in the right-left direction X and the front-rear direction Y in the unfolded state of the carriage drive mechanism 30. When the carriage 35 is moved by the carriage drive mechanism 30 in the above manner, the machine main unit 1 sews cloth on the embroidery frame 5 held by the carriage 35 (in this case, the machine main unit 1 performs sewing in cooperation with the movements of the embroidery unit 3 (movements of the carriage drive mechanism 30)), so that it is possible to realize so-called "embroidery stitching", which is intended to embroider letters, patterns, etc., on the cloth.

Figure 2:
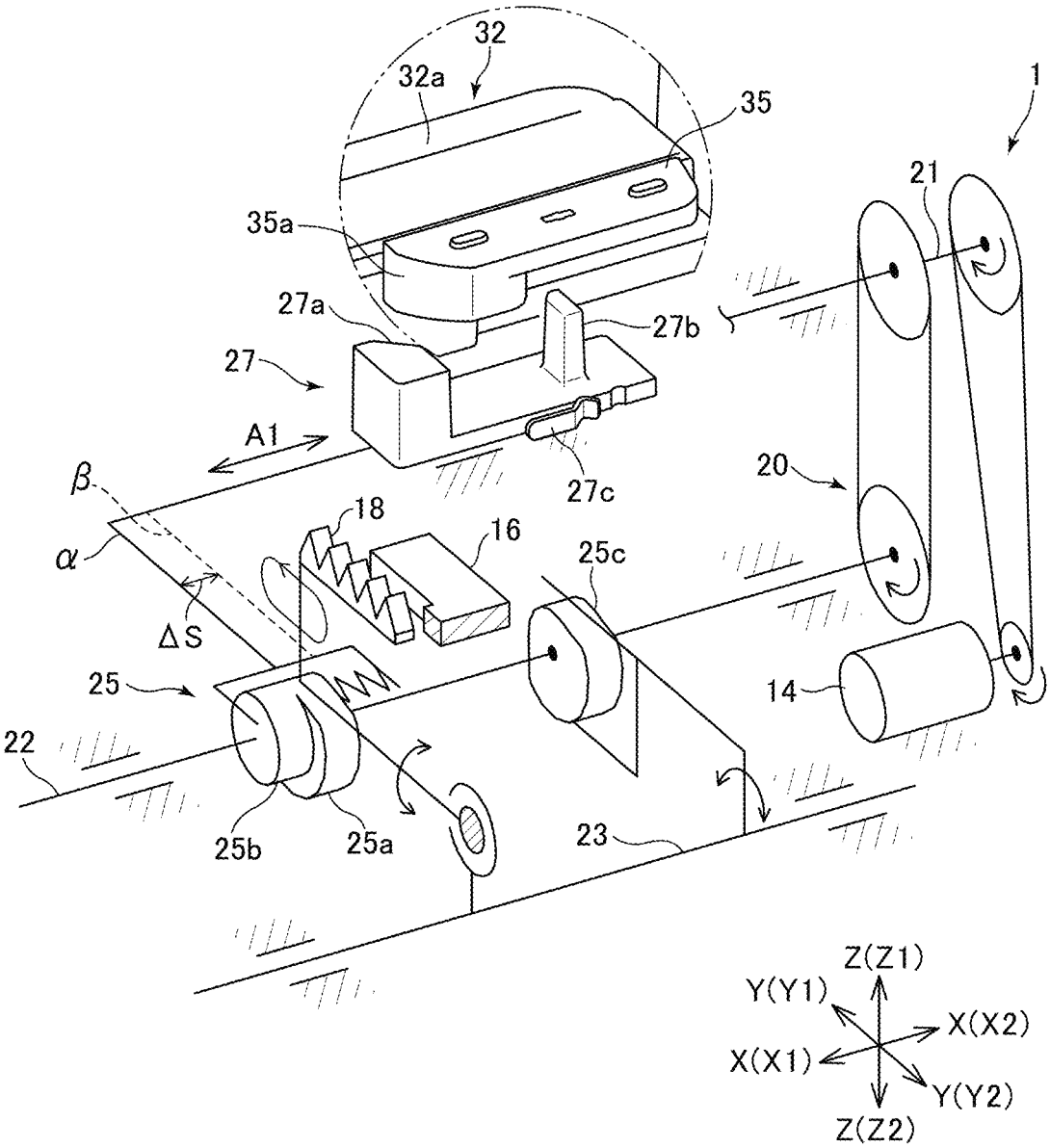
FIG. 2 is a perspective view schematically showing the internal configuration of a machine main unit of the sewing machine according to the embodiment of the present invention.

Next, the internal configuration of the machine main unit 1 of this embodiment will be described with reference to FIG. 2. FIG. 2 is a perspective view schematically showing the internal configuration of the machine main unit 1 in this embodiment. It should be noted that FIG. 2 also shows a portion of the embroidery unit 3, specifically the carriage 35, etc.

As shown in FIG. 2, the torque of the drive motor 14 in the machine main unit 1 is transmitted to an upper shaft 21 and a lower shaft 22 via a transmission mechanism 20. The upper shaft 21 is connected to a needle drive mechanism (not shown) through which the needle 15 (not shown) is moved up and down by the torque of the drive motor 14. On the other hand, the lower shaft 22 is provided with a feed dog drive mechanism 25 for driving a feed dog 18 for feeding cloth in the front-rear direction Y. The feed dog drive mechanism 25 mainly comprises a feed dog up-down cam 25*a* for reciprocating the feed dog 18 in the up-down direction Z, and a feed dog forward-rearward cam 25*c* for reciprocating the feed dog 18 in the front-rear direction Y. The movements of the feed dog up-down cam 25*a* and feed dog forward-rearward cam 25*c* are synthesized and transmitted, and this makes it possible for the feed dog 18 to perform a movement having an elliptically-shaped trajectory (annular trajectory extending in the up-down direction Z and the front-rear direction Y). As a result, the feed dog 18 performs forward and rearward movements while descending and ascending with respect to the needle plate 16 (performing up and down movements), and this makes it possible to intermittently move the cloth in the forward direction Y1 by the feed dog 18.

Further, in the feed dog drive mechanism 25, the feed dog up-down cam 25*a* is configured to be slidable with respect to the lower shaft 22 in the right-left direction X, and a feed dog down cam 25*b* is provided next to the left side of the feed dog up-down cam 25*a*. This feed dog down cam 25*b* is integrally connected to the feed dog up-down cam 25*a*, and is slidable in the right-left direction X together with the feed dog up-down cam 25*a*. The feed dog up-down cam 25*a* and the feed dog down cam 25*b* are slidably driven by a switching mechanism 27 connected to the feed dog drive mechanism 25. That is, by sliding the switching mechanism 27 in the right-left direction X (two-sided arrowed line A1), a cam to be applied in the feed dog drive mechanism 25 is switched between the feed dog up-down cam 25*a* and the feed dog down cam 25*b*.

As shown in FIG. 2, when the switching mechanism 27 is in a position corresponding to a position α, the feed dog up-down cam 25*a* and the feed dog down cam 25*b* are positioned on the left side, as a whole, and thus the feed dog up-down cam 25*a* is applied in the feed dog drive mechanism 25. In this case, according to a cam face of the feed dog up-down cam 25*a*, the feed dog 18 reciprocates in the up-down direction Z in conjunction with the rotation of the lower shaft 22. Specifically, the feed dog 18 reciprocates in the up-down direction Z to descend and ascend with respect to the needle plate 16, and also reciprocates in the front-rear direction Y. Such a state of the feed dog 18 is an operating state in which said feed dog 18 function to feed the cloth.

Then, when the switching mechanism 27 is slid in the rightward direction X2 by a distance ΔS from the position corresponding to the position α, the switching mechanism 27 is moved to a position corresponding to a position β (indicated by a dashed line), and thus the feed dog up-down cam 25*a* and the feed dog down cam 25*b* are moved to the right side, as a whole. In this case, the feed dog down cam 25*b* is applied in the feed dog drive mechanism 25. The feed dog down cam 25*b* is formed such that a cam face thereof has a simple circular shape. Thus, when this cam face is applied, the feed dog 18 does not reciprocate in the up-down direction Z in conjunction with the rotation of the lower shaft 22, but merely reciprocates in the front-rear direction Y according to the feed dog forward-rearward cam 25*c*. That is, in this case, the feed dog 18 is kept constant in terms of its position in the up-down direction Z, and stays in a position lower than the needle plate 16. Such a state of the feed dog 18 is a non-operating state in which said feed dog 18 is prevented from functioning to feed the cloth.

As above, in this embodiment, the operating and non-operating states of the feed dog 18 are switched therebetween by sliding the feed dog up-down cam 25*a* and the feed dog down cam 25*b* of the feed dog drive mechanism 25, using the switching mechanism 27 connected to the feed dog drive mechanism 25. In other words, the operating and non-operating states of the feed dog 18 are switched therebetween by sliding the switching mechanism 27 in the right-left direction X (two-sided arrowed line A1).

Generally, when the normal stitching is performed, the feed dog 18 is set to the operating state. On the other hand, when the embroidery stitching is performed, the movements of cloth are performed by the embroidery unit 3, and thus the feed dog 18 is set to the non-operating state. However, even in the normal stitching, when a user performs sewing along a free trajectory while manually moving cloth (free-motion stitching), the feed dog 18 can be set to the non-operating state.

Figure 3:
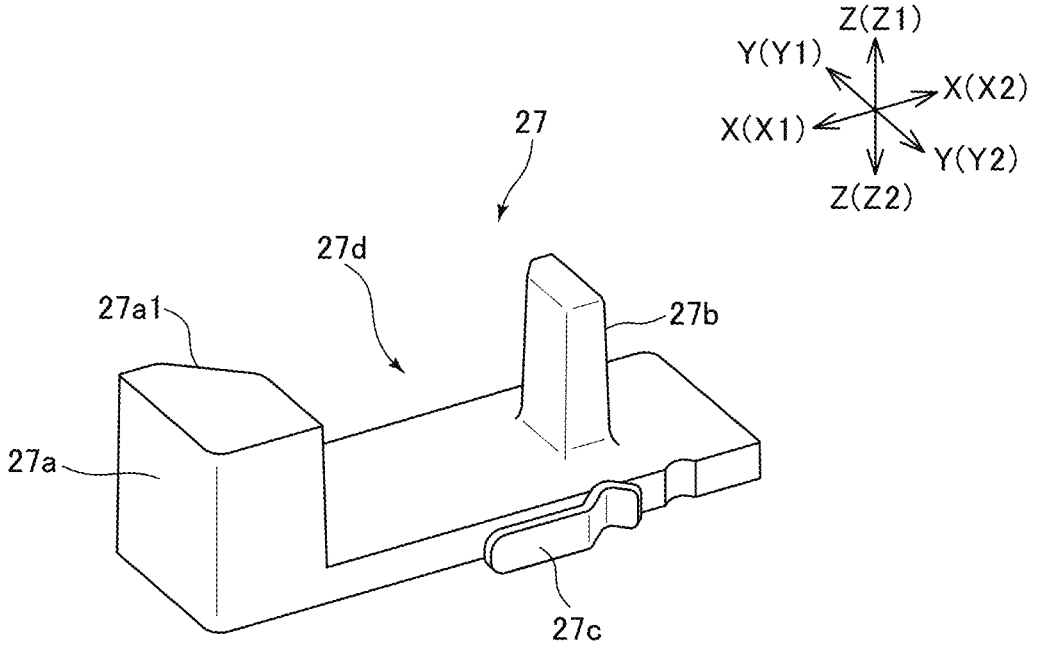
FIG. 3 is a perspective view showing the external appearance of a switching mechanism in the embodiment of the present invention.
Figure 4:
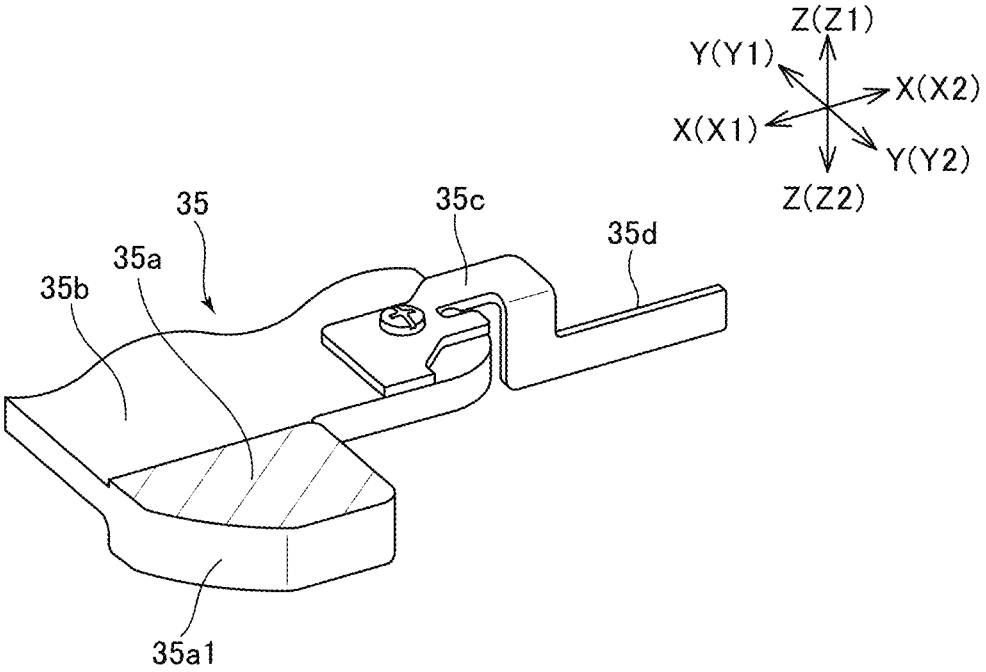
FIG. 4 is a perspective sectional view showing a portion of a carriage in the embodiment of the present invention.

Next, with reference to FIGS. 3 and 4 in addition to FIG. 2, the switching mechanism 27 and the carriage 35 of the embroidery unit 3 will be specifically described. FIG. 3 is a perspective view showing the external appearance of the switching mechanism 27 in this embodiment. FIG. 4 is a perspective sectional view showing a portion of the carriage 35 in this embodiment, take along the X-Y plane. FIG. 4 shows the carriage 35 when it is in the state illustrated in FIG. 2 (when the carriage drive mechanism 30 is in the folded state).

As shown in FIGS. 2 and 3, the switching mechanism 27 comprises: a first to-be-pressed part 27*a* provided at the end of the switching mechanism 27 in the leftward direction X1 and formed to protrude in the up direction Z1; a second to-be-pressed part 27*b* provided in the vicinity of the end of the switching mechanism 27 in the rightward direction X2, with a gap 27*d* with respect to the first to-be-pressed part 27*a*, and formed to protrude in the up direction Z1; and a leaf spring 27*c* for fixing (stopping) the switching mechanism 27 in a position after sliding the switching mechanism 27.

Further, as shown in FIGS. 2 and 4, the carriage 35 comprises: a first pressing part 35*a* formed to protrude in the rearward direction Y2 to engage (fit) in the gap 27*d* (FIG. 3) between the first to-be-pressed part 27*a* and the second to-be-pressed part 27*b* of the switching mechanism 27, in the folded state of the carriage drive mechanism 30; a carriage body 35*b* integrally connected to the first pressing part 35*a*; and a metal piece 35*c* attached to the carriage body 35*b*. In this case, the dimension in the right-left direction X of the first pressing part 35*a* of the carriage 35 is set to be slightly less than the dimension in the right-left direction X of the gap 27*d* between the first to-be-pressed part 27*a* and the second to-be-pressed part 27*b* of the switching mechanism 27 (FIG. 2), whereby the first pressing part 35*a* can engage (fit) in the gap 27*d* between the first to-be-pressed part 27*a* and the second to-be-pressed part 27*b*. Further, in the carriage 35, a plate-shaped portion of the metal piece 35*c* located on the right side and extending in the right-left direction X makes up a second pressing part 35*d* for pressing the second to-be-pressed part 27*b* of the switching mechanism 27 in the unfolded state of the carriage drive mechanism 30. Although details will be described later, the second pressing part 35*d* is housed in the cover 32*a* of the Y-arm 32 during embroidering by the embroidery unit 3 (FIG. 2), and when the carriage 35 is moved from this state in the rearward direction Y2 (particularly in the unfolded state of the carriage drive mechanism 30), the second pressing part 35*d* protrudes from the rear end of the cover 32*a*.

In this embodiment, in the folded state of the carriage drive mechanism 30, the first pressing part 35*a* of the carriage 35 engages in the gap 27*d* between the first to-be-pressed part 27*a* and the second to-be-pressed part 27*b* of the switching mechanism 27, and in this engagement state, the carriage 35 is moved in the right-left direction X by the carriage drive mechanism 30. As a result, the first pressing part 35*a* of the carriage 35 presses either one of the first to-be-pressed part 27*a* and the second to-be-pressed part 27*b* of the switching mechanism 27, to slide the switching mechanism 27 in the left-right direction X (two-sided arrow A1), whereby the operating state and non-operating state of the feed dog 18 are switched therebetween.

Further, as shown in FIGS. 3 and 4, the first to-be-pressed part 27*a* of the switching mechanism 27 and the first pressing part 35*a* of the carriage 35 are formed, respectively, with inclined faces 27*a*1 and 35*a*1 which are opposed to each other in the folded state of the carriage drive mechanism 30, and come into contact with each other during the pressing of the first to-be-pressed part 27*a* by the first pressing part 35*a*.

Figure 5:
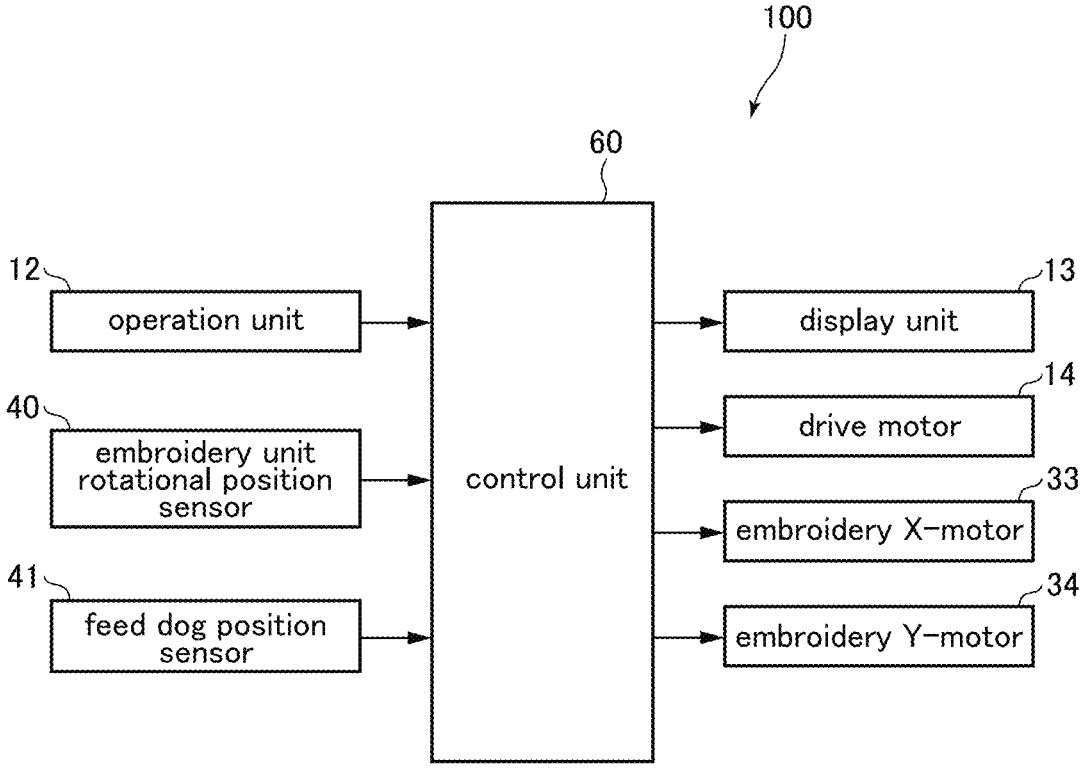
FIG. 5 is a block diagram showing the electrical configuration of the sewing machine according to the embodiment of the present invention.

Next, with reference to FIG. 5, the electrical configuration of the sewing machine 100 according to this embodiment will be described. FIG. 5 is a block diagram showing the electrical configuration of the sewing machine 100 according to this embodiment.

As shown in FIG. 5, the sewing machine 100 comprises a control unit 60 for performing various controls in said sewing machine 100. The control unit 60 is provided inside the machine main unit 1. The control unit 60 is configured to accept input signals from: the operation unit 12 which is operated by the user; the embroidery unit rotational position sensor 40 which detects the unfolded and folded states of the carriage drive mechanism 30; and a feed dog position sensor 41 which detects the operating and non-operating states of the feed dog 18, i.e., detects an up-down position of the feed dog 18. Then, based on these input signals, the control unit 60 outputs control signals to the display unit 13 to display various information thereon, the drive motor 14 provided in the machine main unit 1, the embroidery X-motor 33 provided in the X-arm 31 of the embroidery unit 3, and the embroidery Y-motor 34 provided in the Y-arm 32 of the embroidery unit 3, thereby controlling them. Here, the embroidery unit rotational position sensor 40 and the feed dog position sensor 41 correspond, respectively, to "first sensor" and "second sensor" set forth in the appended claims.

<Switching Between Operating and Non-Operating States of Feed Dog>

Next, a method of switching between the operating and non-operating states of the feed dog 18 performed by the switching mechanism 27 and the carriage 35 in each of the unfolded and folded states of the carriage drive mechanism 30 in this embodiment will be described.

(Switching in Folded State of Carriage Drive Mechanism)

Figure 6A:
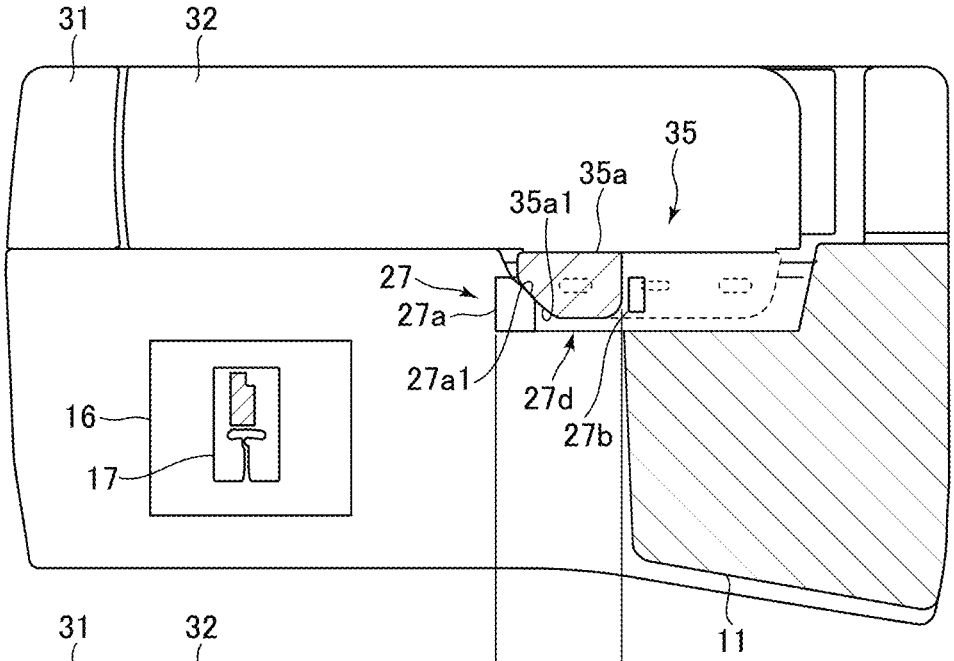
FIGS. 6A and 6B are explanatory diagrams of a technique of switching between an operating state and a non-operating state of a feed dog, which is performed in the embodiment of the present invention when a carriage drive mechanism is in a folded state.
Figure 6B:
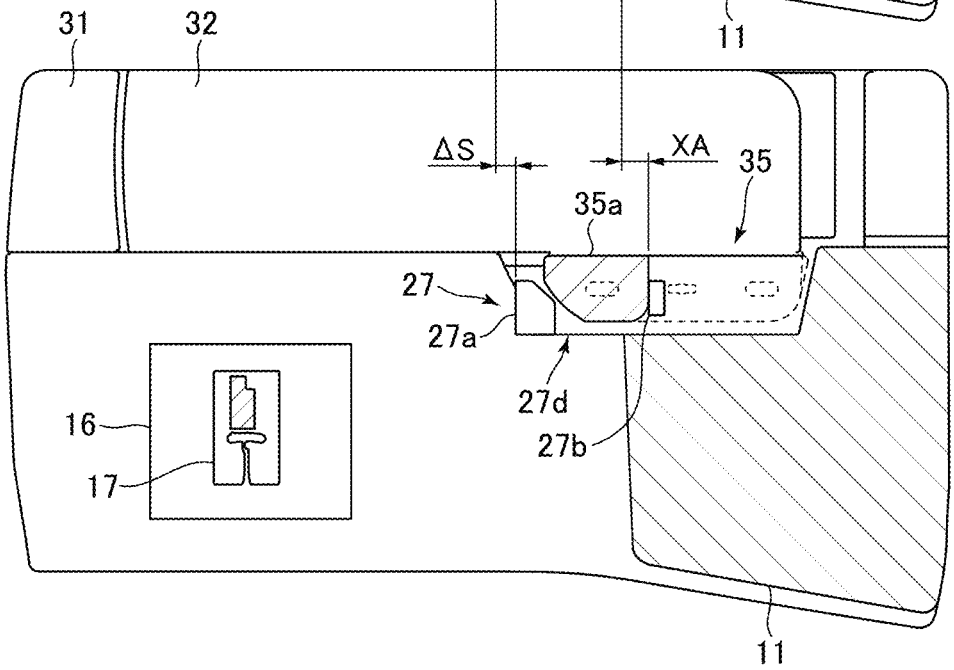
Figure 6B:
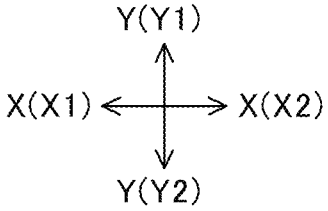

First, with reference to FIGS. 6A and 6B, a method of switching between the operating and non-operating states of the feed dog 18 performed in the folded state of the carriage drive mechanism 30 in this embodiment will be described. FIGS. 6A and 6B are cross-sectional views of a portion of the machine main unit 1 and the embroidery unit 3 (the machine arm 11, the switching mechanism 27, the Y-arm 32, the carriage 35, etc.), taken along the X-Y plane and when viewed from thereabove. FIG. 6A shows the states of the switching mechanism 27 and the carriage 35 when the feed dog 18 (not shown) is in the operating state, and FIG. 6B shows the states of the switching mechanism 27 and the carriage 35 when the feed dog 18 is in the non-operating state.

As shown in FIGS. 6A and 6B, in the folded state of the carriage drive mechanism 30, the first pressing part 35*a* of the carriage 35 engages, i.e., fit, in the gap 27*d* between the first to-be-pressed part 27*a* and the second to-be-pressed part 27*b* of the switching mechanism 27, as mentioned above. In this engagement state, when the carriage 35 is moved in the leftward direction X1 by the carriage drive mechanism 30, the first pressing part 35*a* of the carriage 35 presses the first to-be-pressed part 27*a* of the switching mechanism 27, and thus the switching mechanism 27 is slid in the leftward direction X1 (FIG. 6A). At this time, the switching mechanism 27 is located in the position corresponding to the position α, and thus the feed dog 18 is placed in the operating state. During the pressing of the first to-be-pressed part 27*a* by the first pressing part 35*a*, the inclined face 35*a*1 of the first pressing part 35*a* and the inclined face 27*a*1 of the first to-be-pressed part 27*a* come into contact with each other. On the other hand, when the carriage 35 is moved in the rightward direction X2 by the carriage drive mechanism 30, the first pressing part 35*a* of the carriage 35 presses the second to-be-pressed part 27*b* of the switching mechanism 27, and thus the switching mechanism 27 is slid in the rightward direction X2 (FIG. 6B). At this time, the switching mechanism 27 is located in the position corresponding to the position β, and thus the feed dog 18 is placed in the non-operating state.

Such switching between the states of the feed dog 18 is realized such that the control unit 60 of the sewing machine 100 controls the carriage drive mechanism 30, specifically controls at least one of the embroidery X-motor 33 of the X-arm 31 and the embroidery Y-motor 34 of the Y-arm 32 to move the carriage 35 in the leftward direction X1 or the rightward direction X2 by a distance XA and thus move the switching mechanism 27 by the distance ΔS. In this case, when the folded state of the carriage drive mechanism 30 is detected by the embroidery unit rotational position sensor 40, and the operation unit 12 is operated by the user, the control unit 60 controls the carriage drive mechanism 30 to switch between the states of the feed dog 18. Specifically, when the operation unit 12 is operated to cause the feed dog 18 to be shifted to the operating state, the control unit 60 controls the carriage drive mechanism 30 to move the carriage 35 in the leftward direction X1. On the other hand, when the operation unit 12 is operated to cause the feed dog 18 to be shifted to the non-operating state, the control unit 60 controls the carriage drive mechanism 30 to move the carriage 35 in the rightward direction X2.

Here, in a typical example, the control unit 60 controls only the embroidery Y-motor 34 of the Y-arm 32 in the carriage drive mechanism 30 to move the carriage 35 in the left-right direction X. However, in another example, considering that in the folded state, a slight gap (allowance) is set between the X-arm 31 and the Y-arm 32 in the right-left direction X, the control unit 60 may control the embroidery X-motor 33 of the X-arm 31 in the carriage drive mechanism 30 to move the Y-arm 32 within this gap, and thus move the carriage 35 in the right-left direction X. In yet another example, the control unit 60 may control both the embroidery X-motor 33 of the X-arm 31 and the embroidery Y-motor 34 of the Y-arm 32 in the carriage drive mechanism 30 to move the carriage 35 in the right-left direction X.

The positions of the carriage 35, etc., as shown in FIG. 6A, correspond to their home positions in the folded state of the carriage drive mechanism 30. This is because, in the folded state, the normal stitching is basically performed, and therefore the feed dog 18 should be placed in the operating state. Thus, after the sewing machine 100 is powered on, and an operation of returning the embroidery unit 3 to its original position is performed, the carriage 35, etc. stand ready at their home positions as shown in FIG. 6B.

(Switching in Unfolded State of Carriage Drive Mechanism)

Figures 7A, 7B, 7C:
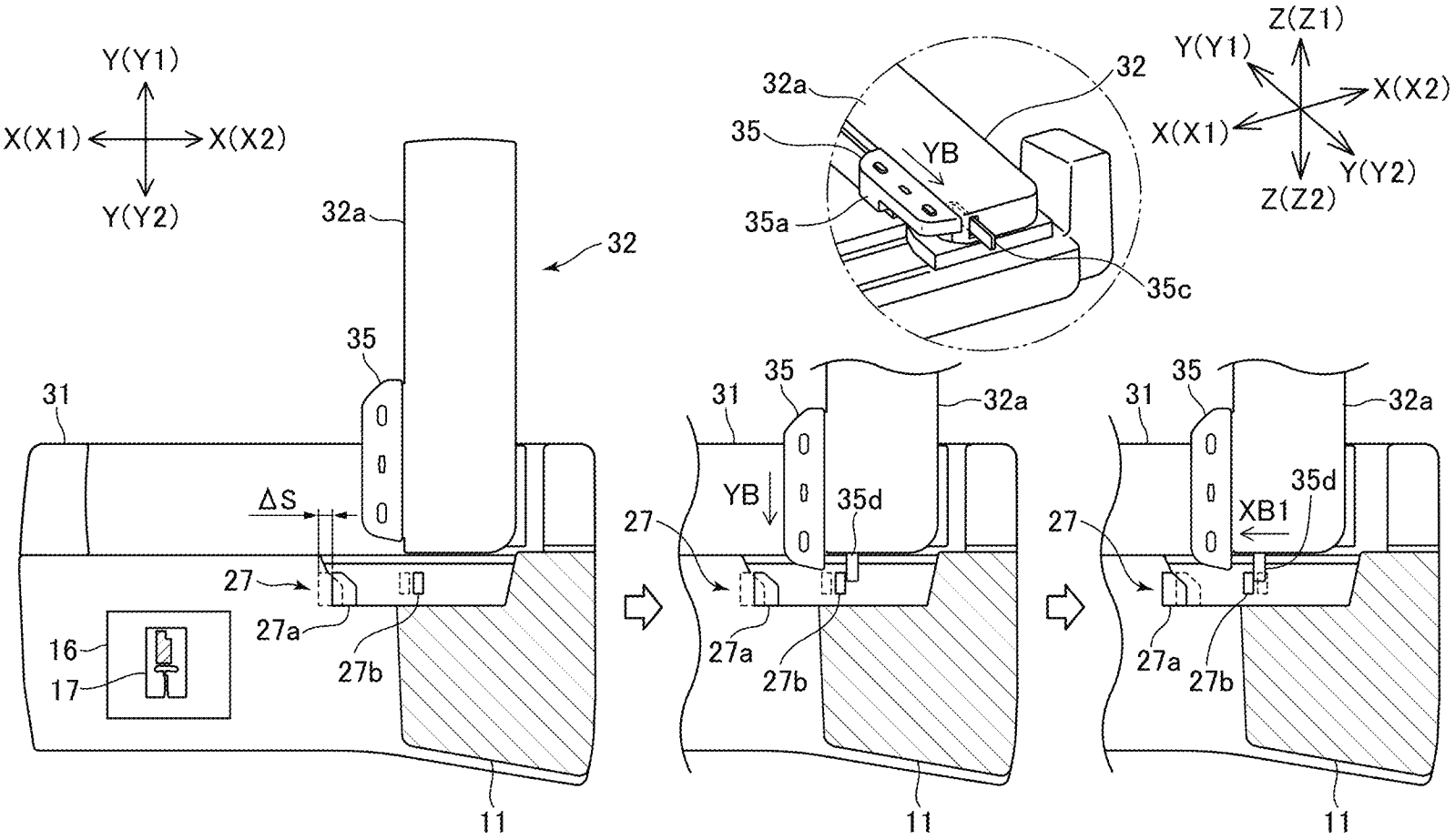
FIGS. 7A to 7C are explanatory diagrams of a technique of switching to the operating state of the feed dog, which is performed in the embodiment of the present invention when the carriage drive mechanism is in an unfolded state.
Figures 8A, 8B, 8C:
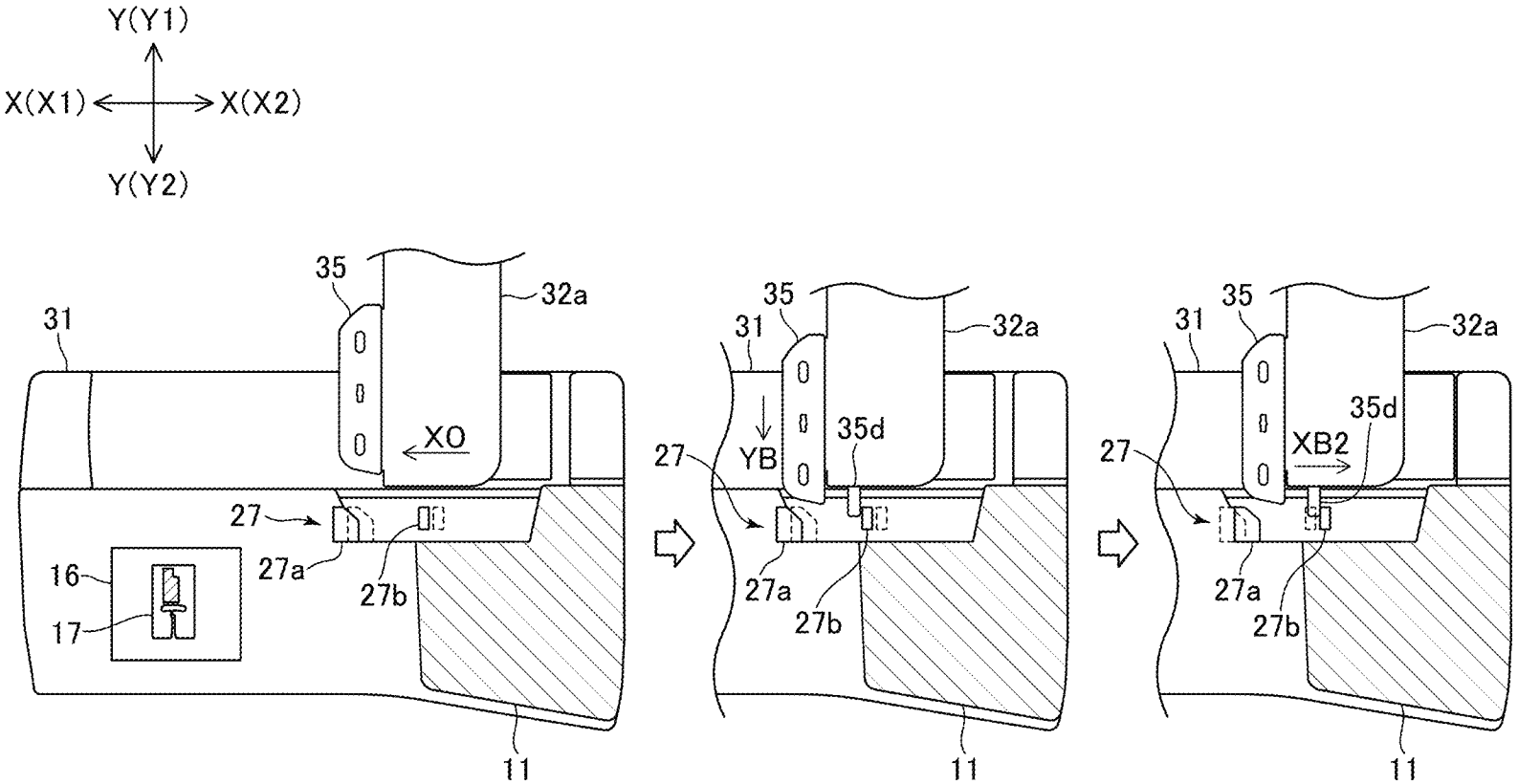
FIGS. 8A to 8C are explanatory diagrams of a technique of switching to the non-operating state of the feed dog, which is performed in the embodiment of the present invention when the carriage drive mechanism is in the unfolded state.

Next, with reference to FIGS. 7A to 7C and 8A to 8C, a method of switching between the operating and non-operating states of the feed dog 18 in the unfolded state of the carriage drive mechanism 30 in this embodiment will be described. As with FIGS. 6A and 6B, FIGS. 7A to 7C and 8A to 8C are cross-sectional views of a portion of the machine main unit 1 and the embroidery unit 3 (the machine arm 11, the switching mechanism 27, the Y-arm 32, the carriage 35, etc.), taken along the X-Y plane and when viewed from thereabove. In particular, FIGS. 7A to 7C show the movements of the switching mechanism 27 and the carriage 35 when switching the feed dog 18 to the operating state, and FIGS. 8A to 8C show the movements of the switching mechanism 27 and the carriage 35 when switching the feed dog 18 to the non-operating state. It should be noted that an enlarged perspective view showing the second pressing part 35*d* of the carriage 35 which protrudes from the cover 32*a* of the Y-arm 32 is additionally presented on the upper side of FIG. 7B.

FIG. 7A shows home positions of the Y-arm 32 and the carriage 35 in the unfolded state of the carriage drive mechanism 30. Here, assume that the switching mechanism 27 is located in the position corresponding to the position β. In this state, when the carriage 35 is moved in the rearward direction Y2 by the Y-arm 32 of the carriage drive mechanism 30 (arrowed line YB), the second pressing part 35*d* of the carriage 35 protrudes from the rear end of the cover 32*a* of the Y-arm 32, as shown in FIG. 7B. In this case, the protruding second pressing part 35*d* is located on the right side of the second to-be-pressed part 27*b* of the switching mechanism 27. In this state, when the carriage 35 is moved in the leftward direction X1 (arrowed line XB1) by the X-arm 31 of the carriage drive mechanism 30 together with the Y-arm 32, the second pressing part 35*d* of the carriage 35 comes into contact with the second to-be-pressed part 27*b* of the switching mechanism 27 and presses the second to-be-pressed part 27*b*, and thus the switching mechanism 27 is slid in the leftward direction X1, as shown in FIG. 7C. As a result, the switching mechanism 27 is moved to the position corresponding to the position α, and thus the feed dog 18 is placed in the operating state. Here, since the second pressing part 35*d* is composed of a plate-shaped portion of the metal piece 35*c* (FIG. 4), it undergoes elastic deformation when pressing the second to-be-pressed part 27*b*.

Such switching between the states of the feed dog 18 is performed by the control unit 60 of the sewing machine 100 when a user's operation for causing the feed dog 18 to be shifted to the operating state is performed on the operation unit 12 in a situation where the unfolded state of the carriage drive mechanism 30 is detected by the embroidery unit rotational position sensor 40. In this case, the control unit 60 controls the embroidery X-motor 33 of the X-arm 31 and the embroidery Y-motor 34 of the Y-arm 32 in the carriage drive mechanism 30 to move the carriage 35 in the rearward direction Y2 and then in the leftward direction X1 in sequence, as mentioned above.

Then, when switching the feed dog 18 to the non-operating state, the Y-arm 32 and the carriage 35 are first moved from their home positions (FIG. 7A) in the leftward direction X1 (arrowed line XO) by the X-arm 31 of the carriage drive mechanism 30, as shown in FIG. 8A. Here, assume that the switching mechanism 27 is located in the position corresponding to the position α. In this state, when the carriage 35 is moved in the rearward direction Y2 by the Y-arm 32 of the carriage drive mechanism 30 (arrowed line YB), the second pressing part 35*d* of the carriage 35 protrudes from the rear end of the cover 32*a* of the Y-arm 32, as shown in FIG. 8B. In this case, the protruding second pressing part 35*d* is located on the left side of the second to-be-pressed part 27*b* of the switching mechanism 27. In this state, when the carriage 35 is moved in the rightward direction X2 (arrowed line XB2) by the X-arm 31 of the carriage drive mechanism 30 together with the Y-arm 32, the second pressing part 35*d* of the carriage 35 comes into contact with the second to-be-pressed part 27*b* of the switching mechanism 27 and presses the second pressed part 27*b*, and thus the switching mechanism 27 is slid in the rightward direction X2, as shown in FIG. 8C. As a result, the switching mechanism 27 is moved to the position corresponding to the position β, and thus the feed dog 18 is placed in the non-operating state.

Such switching between the states of the feed dog 18 is performed by the control unit 60 of the sewing machine 100 when a user's operation for causing the feed dog 18 to be shifted to the non-operating state is performed on the operation unit 12 in a situation where the unfolded state of the carriage drive mechanism 30 is detected by the embroidery unit rotational position sensor 40. In this case, the control unit 60 controls the embroidery X-motor 33 of the X-arm 31 and the embroidery Y-motor 34 of the Y-arm 32 in the carriage drive mechanism 30 to move the carriage 35 in the leftward direction X1, in the rearward direction Y2 and then in the rightward direction X2 in sequence, as mentioned above.

(Switching During Shifting from Unfolded State to Folded State of Carriage Drive Mechanism)

Next, with reference to FIGS. 9A to 9C, a method of switching the state of the feed dog 18 to the operating state during shifting from the unfolded state to the folded state of the carriage drive mechanism 30 in this embodiment will be described. As with FIGS. 6A and 6B, etc., FIGS. 9A and 9B are cross-sectional views of a portion of the machine main unit 1 and the embroidery unit 3 (the machine arm 11, the switching mechanism 27, the Y-arm 32, the carriage 35, etc.), taken along the X-Y plane and when viewed from thereabove.

Figures 9A, 9B, 9C:
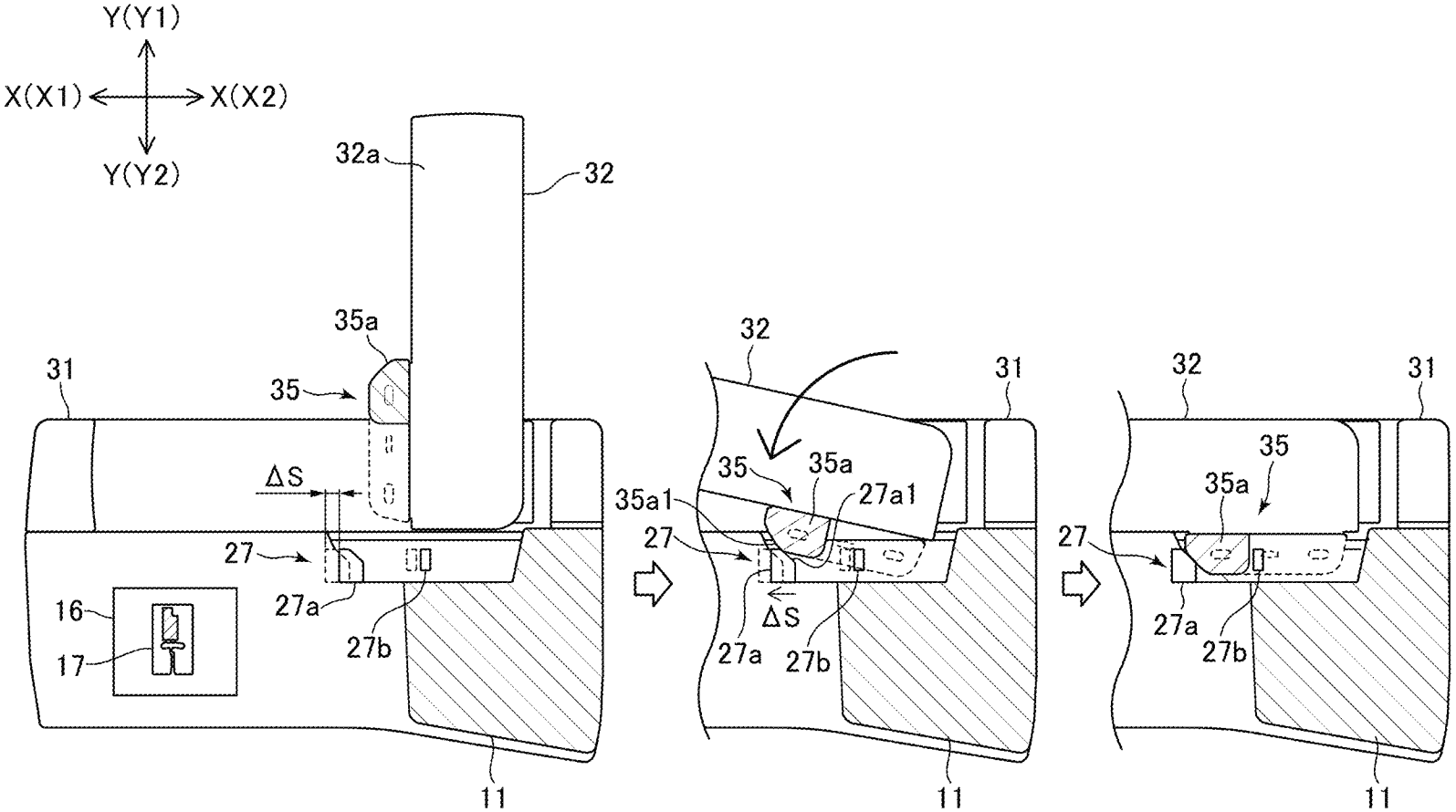
FIGS. 9A to 9C are explanatory diagrams of a technique of switching to the operating state of the feed dog, which is performed in the embodiment of the present invention when the carriage drive mechanism is shifted from the unfolded state to the folded state.

FIG. 9A shows home positions of the Y-arm 32 and the carriage 35 in the unfolded state of the carriage drive mechanism 30. Here, assume that the switching mechanism 27 is located in the position corresponding to the position β. In this state, when the Y-arm 32 is rotated counterclockwise, i.e., when the Y-arm 32 is shifted from the unfolded state to the folded state, the first pressing part 35*a* of the carriage 35 comes into contact with the first to-be-pressed part 27*a* of the switching mechanism 27 at a predetermined rotation angle of the Y-arm 32, as shown in FIG. 9B. More specifically, the inclined face 35*a*1 of the first pressing part 35*a* comes into contact with the inclined face 27*a*1 of the first to-be-pressed part 27*a*. Then, as the Y-arm 32 is further rotated, the first pressing part 35*a* of the carriage 35 presses the first to-be-pressed part 27*a* of the switching mechanism 27, and thus the switching mechanism 27 will be gradually slid in the leftward direction X1. As a result, when the carriage drive mechanism 30 is placed in the folded state, the switching mechanism 27 is located in the position corresponding to the position α, where the switching mechanism 27 has been slid in the leftward direction X1 by the distance ΔS, and therefore the feed dog 18 is placed in the operating state, as shown in FIG. 9C.

<Details of Control>

Next, various controls performed by the control unit 60 of the sewing machine 100 according to this embodiment will be described.

In the above embodiment, the control unit 60 is configured to perform control of switching between the states of the feed dog 18 in consideration of the state (folded state or unfolded state) of the carriage drive mechanism 30 detected by the embroidery unit rotational position sensor 40. Specifically, the control unit 60 is configured to perform control of switching between the states of the feed dog 18, according to the user's operation of the operation unit 12, in addition to the state of the carriage drive mechanism 30 detected by the embroidery unit rotational position sensor 40.

In another embodiment, the control of switching between the states of the feed dog 18 may be performed, based on a plurality of operational modes of the sewing machine 100, typically based on a normal stitching mode for performing the normal stitching, an embroidering mode for performing the embroidery stitching, and others. For example, in the embroidering mode, it is common to operate the feed dog 18 in the non-operating state. Thus, when the embroidering mode is selected as the operational mode of the sewing machine 100 by the user's operation of the operation unit 12, the control unit 60 may control the carriage drive mechanism 30 to slide the switching mechanism 27 by the carriage 35 so as to automatically set feed dog 18 to the non-operating state.

On the other hand, in the normal stitching mode, it is common to operate the feed dog 18 in the operating state. Thus, when the normal stitching mode is selected as the operational mode of the sewing machine 100 by the user's operation of the operation unit 12, the control unit 60 may control the carriage drive mechanism 30 to slide switching mechanism 27 by the carriage 35, so as to automatically set the state of the feed dog 18 to the operating state. In this case, even when the carriage drive mechanism 30 is in the unfolded state, the feed dog 18 may be automatically switched to the operating state.

In yet another embodiment, the control unit 60 may perform the following control, based on the state (operating state or non-operating state) of the feed dog 18 (i.e., the up-down position of the feed dog 18) detected by the feed dog position sensor 41. That is, the control unit 60 may determine whether or not the state of the feed dog 18 detected by the feed dog position sensor 41 is in a set desired state (typically, the state to be set according to the state of the carriage drive mechanism 30), and perform a predetermined control operation according to the result of this determination. For example, in a situation where the carriage drive mechanism 30 is in the folded state, but the feed dog 18 is shifted to the non-operating state by the movement of the switching mechanism 27 in response to the user's operation, the control unit 60 can use the feed dog position sensor 41 to determine that the feed dog 18 is in such a state, i.e., the feed dog 18 is not in the desired state, and perform a predetermined control operation. In this case, as one example, the control unit 60 may operate to power off the sewing machine 100, or to display a request for power-off on the display unit 13, or to display on the display unit 13 a warning indicating that the feed dog 18 is in the non-operating state, or to display on the display unit 13 a request for the user's operation for causing the feed dog 18 to be shifted to the operating state.

Functions and Effects

Hereinafter, functions and effects of the sewing machine 100 according to the above embodiment will be described.

A sewing machine 100 according to the above embodiment is designed to form stitches on cloth by moving a needle 15 up and down. The sewing machine 100 comprises: a feed dog 18 which feeds cloth in a front-rear direction; a feed dog drive mechanism 25 which drives the feed dog 18 to cause the feed dog 18 to reciprocate in the front-rear direction Y and in an up-down direction Z; a switching mechanism 27 connected to the feed dog drive mechanism 25, and capable of being slid in a right-left direction X to thereby drive the feed dog drive mechanism 25 to switch between an operating state in which the feed dog 18 is allowed to function to feed the cloth and a non-operating state in which the feed dog 18 is prevented from functioning to feed the cloth; a carriage 35 which holds an embroidery frame 5 for embroidering cloth; and a carriage drive mechanism 30 comprising an X-arm 31 and a Y-arm 32 each capable of driving the carriage 35 linearly, wherein a linear drive direction of the X-arm is set to the right-left direction X, and a linear drive direction of the Y-arm 31 is set to the front-rear direction Y, whereby the carriage drive mechanism 30 can move the carriage 35 in the right-left direction X and the front-rear direction Y, wherein the carriage drive mechanism 30 is configured to be switchable between an unfolded state in which the X-arm 31 and the Y-arm 32 have a positional relationship where the respective linear drive directions thereof are orthogonal to each other, and a folded state in which the X-arm 31 and the Y-arm 32 have a positional relationship where the respective linear drive directions thereof are parallel to each other, and wherein the carriage 35 and the switching mechanism 27 are configured such that when the carriage drive mechanism 30 is in the folded state, a state is formed in which the carriage 35 can press the switching mechanism 27 to slide the switching mechanism 27, whereby when the carriage drive mechanism 30 in the folded state moves the carriage 35 in the right-left direction X by at least one of the X-arm 31 and the Y-arm 32, the switching mechanism 27 is slid, and thus the operating state and the non-operating state of the feed dog 18 are switched therebetween.

The above embodiment makes it possible to, in the folded state of the cartridge drive mechanism 30, adequately switch between the operating and non-operating states of the feed dog 18 through the switching mechanism 30, using the movement of the carriage 35 by the carriage drive mechanism 30.

In the above embodiment, the sewing machine 100 is configured such that the carriage 35 and the switching mechanism 27 at least partially engage with each other when the carriage drive mechanism 30 is in the folded state. Thus, in the folded state of the cartridge drive mechanism 30, it becomes possible to realize sliding movement of the switching mechanism 27 by the carriage 35, with a simple configuration.

In the above embodiment, the switching mechanism 27 comprises a first to-be-pressed part 27*a* provided on the left side (on the side of the leftward direction), and a second to-be-pressed part 27*b* provided on the right side (on the side of the rightward direction X2); and the carriage 35 comprises a first pressing part 35*a* provided to engage with the switching mechanism 37 between the first to-be-pressed part 27*a* and the second to-be-pressed part 27*b* of the switching mechanism 27, when the carriage drive mechanism 30 is in the folded state, wherein the sewing machine 100 is configured such that in a situation where the carriage drive mechanism 30 is in the folded state, (i) when the carriage 35 is moved in the leftward direction X1, the first pressing part 35*a* of the carriage 35 presses the first to-be-pressed part 27*a* of the switching mechanism 27, and thus the switching mechanism 27 is slid in the leftward direction X1, whereby the feed dog 18 is placed in the operating state, and (ii) when the carriage 35 is moved in the rightward direction X2, the first pressing part 35*a* of the carriage 18 presses the second to-be-pressed part 27*b* of the switching mechanism 27, and thus the switching mechanism 27 is slid in the rightward direction X2, whereby the feed dog 18 is placed in the non-operating state. Thus, in the folded state of the cartridge drive mechanism 30, it becomes possible to reliably switch between the operating and non-operating states of the feed dog 18 by the carriage 35 and the switching mechanism 27.

In the above embodiment, the carriage 35 further comprises a second pressing part 35*d* provided to be contactable with a face of the second to-be-pressed part 27*b* of the switching mechanism 27 on the left or right side (on the side of the leftward direction X1 or the rightward direction X2), when the carriage drive mechanism 30 is in the unfolded state, wherein the sewing machine 100 is configured such that in a situation where the carriage drive mechanism 30 is in the unfolded state, (i) when the carriage 35 is moved in the leftward direction X1 with the second pressing part 35*d* of the carriage 35 being in contact with the face of the second to-be-pressed part 27*b* of the switching mechanism 27 on the right side, the second pressing part 35*d* of the carriage 35 presses the second to-be-pressed part 27*b* of the switching mechanism 27, and thus the switching mechanism 27 is slid in the leftward direction X1, whereby the feed dog is placed in the operating state, and (ii) when the carriage 35 is moved in the rightward direction X2 with the second pressing part 35*d* of the carriage 35 being in contact with the face of the second to-be-pressed part 27*b* of the switching mechanism 27 on the left side, the second pressing part 35*d* of the carriage 35 presses the second to-be-pressed part 27*b* of the switching mechanism 27, and thus the switching mechanism 27 is slid in the rightward direction X2, whereby the feed dog 18 is placed in the non-operating state. Thus, in the unfolded state of the cartridge drive mechanism 30, it becomes possible to reliably switch between the operating and non-operating states of the feed dog 18 by the carriage 35 and the switching mechanism 27.

In the above embodiment, the sewing machine 100 is configured such that, in conjunction with an operation by which the carriage drive mechanism 30 is switched from the unfolded state to the folded state, the first pressing part 35*a* of the carriage 35 presses the first to-be-pressed part 27*a* of the switching mechanism 27, and thus the switching mechanism 27 is slid in the leftward direction X1, whereby when the carriage drive mechanism 30 has been switched to the folded state, the feed dog 28 is placed in the operating state. Thus, it becomes possible to switch the feed dog 18 from the non-operating state to the operating state, in conjunction with the operation of shifting the carriage drive mechanism 30 from the unfolded state to the folded state.

In the above embodiment, the first to-be-pressed part 27*a* of the switching mechanism 27 and the first pressing part 35*a* of the carriage 35 are formed, respectively, with inclined faces 27*a*1, 35*a*1 which are opposed to each other in the folded state, and come into contact with each other during the pressing of the first to-be-pressed part 27*a* by the first pressing part 35*a*. Thus, the first to-be-pressed part 27*a* of the switching mechanism 27 and the first pressing part 35*a* of the carriage 35 can be brought into contact with each other through their inclined faces 27*a*1, 35*a*1, so that it becomes possible to mitigate a force applied during the pressing of the first to-be-pressed part 27*a* by the first pressing part 35*a*.

In the above embodiment, the sewing machine 100 further comprises: an embroidery unit rotational position sensor 40 capable of detecting the unfolded state and the folded state of the carriage drive mechanism 30; and a control unit 60 configured to switch between the movements of the carriage 35 for sliding the switching mechanism 27, based on the state of the carriage drive mechanism 30 defected by the embroidery unit rotational position sensor 40. Thus, it becomes possible to adequately switch between the operating and non-operating states of the feed dog 18, in consideration of the state of the carriage drive mechanism 30.

In the above embodiment, the sewing machine 100 has a plurality of operational modes (e.g., a normal stitching mode, and an embroidering mode), wherein the sewing machine 100 further comprises a control unit 60 configured to control the movement of the carriage drive mechanism 30 to switch between the operating state and the non-operating state of the feed dog 18, based on a selected one of the operational modes. Thus, it becomes possible to adequately switch between the operating and non-operating states of the feed dog 18 in consideration of the selected operational mode of the sewing machine.

In the above embodiment, the sewing machine 100 further comprises: a feed dog position sensor 41 capable of detecting the operating state and the non-operating state of the feed dog 18; and a control unit 60 configured to determine whether or not the state of the feed dog 18 detected by the feed dog position sensor 41 is in a set desired state, and perform a predetermined control operation according to a result of the determination. Thus, when the state of the feed dog 18 is not in the desired state, it becomes possible to adequately perform control for correcting this state.

MODIFIED EXAMPLES

Figure 10:
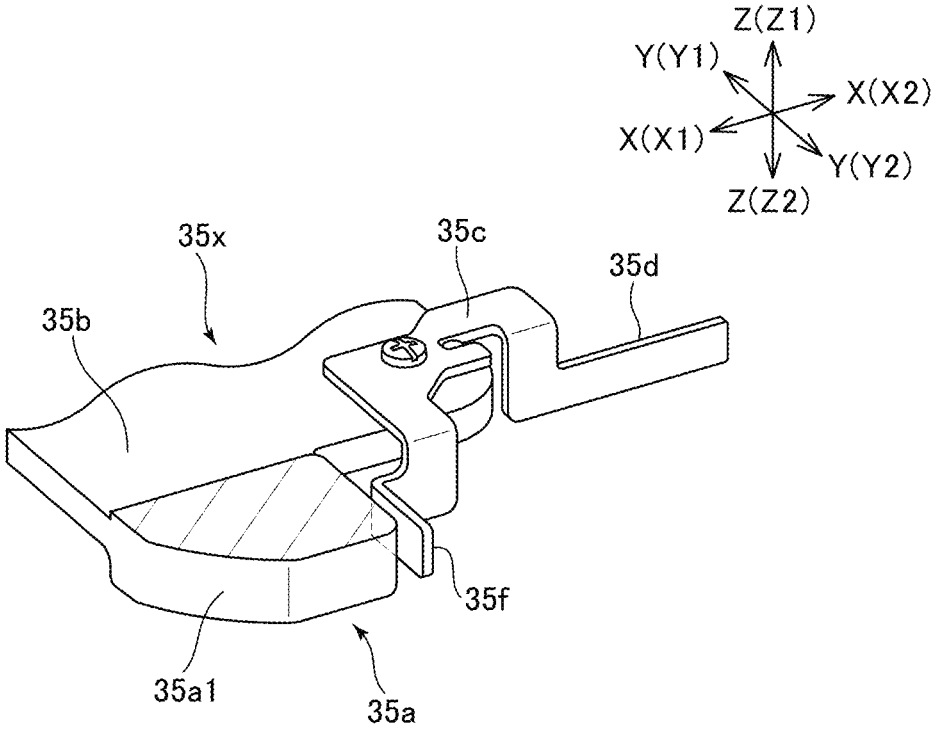
FIG. 10 is a perspective sectional view showing a portion of a carriage in a modified example of the embodiment of the present invention.

Hereinafter, modified examples of the above embodiment will be described. First, with reference to FIG. 10, a carriage in a modified example of the above embodiment will be described. FIG. 10 is a perspective sectional view showing a portion of the carriage in the modified example of the above embodiment. As with FIG. 4, FIG. 10 is a perspective sectional view of the carriage in the state illustrated in FIG. 2 (the folded state of the carriage drive mechanism 30).

As shown in FIG. 10, in the carriage 35*x* in the modified example, the metal piece 35*c* is further provided with a plate-shaped resilient member 35*f*. The resilient member 35*f* is provided at a left end of the metal piece 35*c* and formed to extend in the front-rear direction Y. In the modified example, this resilient member 35*f* functionally makes up a portion of the first pressing part 35*a*. That is, the resilient member 35*f* functions as a pressing portion of the first pressing part 35*a* which presses the second to-be-pressed part 27*b* of the switching mechanism 27 when switching the feed dog 18 to the non-operating state, in the folded state of the carriage drive mechanism 30 (FIG. 6B). Further, since the resilient member 35*f* is composed of a plate-shaped portion of the metal piece 35*c*, it undergoes elastic deformation when pressing the second to-be-pressed part 27*b*. Such elastic deformation of the resilient member 35*f* makes it possible to mitigate a force applied during the pressing of the second to-be-pressed part 27*b* by the first pressing part 35*a*.

Further, the sewing machine 100 according to the above embodiment is configured such that the carriage 35 is received (fit) into the switching mechanism. Specifically, it is configured such that the first pressing part 35*a* of the carriage 35 engages in the gap 27*d* between the first to-be-pressed part 27*a* and the second to-be-pressed part 27*b* of the switching mechanism 27. Alternatively, the sewing machine may be configured such that the switching mechanism is received (fit) into the carriage. In this case, the sewing machine may be configured such that the carriage is provided with two pressing parts, and the switching mechanism is provided with a single to-be-pressed part which can engage in a gap between the two pressing parts.

What is claimed is:

1. A sewing machine for forming stitches on cloth by moving a needle up and down, the sewing machine comprising:

a feed dog which feeds cloth in a front-rear direction;

a feed dog drive mechanism which drives the feed dog to cause the feed dog to reciprocate in a front-rear direction and in an up-down direction;

a switching mechanism connected to the feed dog drive mechanism, and configured to slide in a first direction in order to switch between an operating state in which the feed dog is allowed to function to feed the cloth and a non-operating state in which the feed dog is prevented from functioning to feed the cloth;

a carriage which holds an embroidery frame for embroidering the cloth; and a carriage drive mechanism comprising a first linear drive mechanism and a second linear drive mechanism each capable of driving the carriage linearly, wherein a linear drive direction of the first linear drive mechanism is the first direction and a linear drive direction of the second linear drive mechanism is a second direction orthogonal to the first direction, such that the carriage drive mechanism is configured to move the carriage in the first and second directions, wherein the carriage drive mechanism is configured to switch between an unfolded state in which the first and second linear drive mechanisms have a positional relationship where the respective linear drive directions thereof are orthogonal to each other, and a folded state in which the first and second linear drive mechanisms have a positional relationship where the respective linear drive directions thereof are parallel to each other, and wherein the switching mechanism can slide by being pressed by the carriage when the carriage drive mechanism is in the folded state, such that the switching mechanism slides when the carriage drive mechanism in the folded state moves the carriage in the first direction, so as to switch between the operating state and the non-operating state of the feed dog.

2. The sewing machine according to claim 1, wherein the carriage and the switching mechanism are configured to at least partially engage with each other, when the carriage drive mechanism is in the folded state.

3. The sewing machine according to claim 2, wherein the switching mechanism comprises a first to-be-pressed part provided on a side of one direction of the first direction, and a second to-be-pressed part provided on a side of the other direction of the first direction, wherein the carriage comprises a first pressing part provided to engage with the switching mechanism between the first to-be-pressed part and the second to-be-pressed part of the switching mechanism, when the carriage drive mechanism is in the folded state, and wherein the sewing machine is configured such that in a situation where the carriage drive mechanism is in the folded state, (i) when the carriage is moved in said one direction, the first pressing part of the carriage presses the first to-be-pressed part of the switching mechanism and the switching mechanism slides in said one direction, whereby the feed dog is placed in the operating state, and (ii) when the carriage is moved in said other direction, the first pressing part of the carriage presses the second to-be-pressed part of the switching mechanism and the switching mechanism slides in said other direction, whereby the feed dog is placed in the non-operating state.

4. The sewing machine according to claim 3, wherein the carriage further comprises a second pressing part provided to be contactable with a face of the second to-be-pressed part of the switching mechanism on the side of said one direction of the first direction or on the side of said other direction of the first direction, when the carriage drive mechanism is in the unfolded state, and wherein the sewing machine is configured such that in a situation where the carriage drive mechanism is in the unfolded state, (i) when the carriage is moved in said one direction with the second pressing part of the carriage being in contact with the face of the second to-be-pressed part of the switching mechanism on the side of said other direction, the second pressing part of the carriage presses the second to-be-pressed part of the switching mechanism and the switching mechanism slides in said one direction, whereby the feed dog is placed in the operating state, and (ii) when the carriage is moved in said other direction with the second pressing part of the carriage being in contact with the face of the second to-be-pressed part of the switching mechanism on the side of said one direction, the second pressing part of the carriage presses the second to-be-pressed part of the switching mechanism and the switching mechanism slides in said other direction, whereby the feed dog is placed in the non-operating state.

5. The sewing machine according to claim 3, wherein, in conjunction with an operation by which the carriage drive mechanism is switched from the unfolded state to the folded state, the first pressing part of the carriage presses the first to-be-pressed part of the switching mechanism and the switching mechanism slides in said one direction, whereby the feed dog is placed in the operating state when the carriage drive mechanism has been switched to the folded state.

6. The sewing machine according to claim 5, wherein the first pressing part of the carriage and the first to-be-pressed part of the switching mechanism are formed, respectively, with inclined faces which are opposed to each other in the folded state, and come into contact with each other during the pressing of the first to-be-pressed part by the first pressing part.

7. The sewing machine according to claim 3, wherein at least a portion of the first pressing part is composed of an elastically-deformable resilient member.

8. The sewing machine according to claim 1, further comprising: a first sensor capable of detecting the unfolded state and the folded state of the carriage drive mechanism; and a control unit configured to switch between movements of the carriage for sliding the switching mechanism, based on the state of the carriage drive mechanism defected by the first sensor.

9. The sewing machine according to claim 1, further comprising a control unit configured to control a movement of the carriage drive mechanism to switch between the operating state and the non-operating state of the feed dog, based on a plurality of operational modes of the sewing machine.

10. The sewing machine according to claim 1, further comprising: a second sensor capable of detecting the operating state and the non-operating state of the feed dog; and a control unit configured to determine whether or not the state of the feed dog detected by the second sensor is in a set desired state, and to perform a predetermined control operation according to a result of the determination.

* * * * *